US005128311A

United States Patent [19]

Egashira et al.

[11] Patent Number: 5,128,311

[45] Date of Patent: Jul. 7, 1992

[54] HEAT TRANSFER IMAGE-RECEIVING SHEET AND HEAT TRANSFER PROCESS

[75] Inventors: Noritaka Egashira; Yoshinori Nakamura, both of Tokyo, Japan

[73] Assignee: Dai Nippon Insatsu Kabushiki Kaisha, Japan

[21] Appl. No.: 499,427

[22] PCT Filed: Oct. 27, 1989

[86] PCT No.: PCT/JP89/01107

§ 371 Date: Jun. 21, 1990

§ 102(e) Date: Jun. 21, 1990

[87] PCT Pub. No.: WO90/04521

PCT Pub. Date: Mar. 5, 1990

[30] Foreign Application Priority Data

Oct. 28, 1988 [JP] Japan ..... 63-270883

[51] Int. Cl.[5] ..... B41M 5/035; B41M 5/26

[52] U.S. Cl. ..... 503/227; 428/195; 428/480; 428/500; 428/913; 428/914

[58] Field of Search ..... 8/471; 428/195, 913, 428/914, 480, 500; 503/227

[56] References Cited

U.S. PATENT DOCUMENTS 4,555,427 11/1985 Kawasaki et al. ..... 428/195

*Primary Examiner*—Bruce H. Hess

*Attorney, Agent, or Firm*—Parkhurst, Wendel & Rossi

[57] ABSTRACT

A heat transfer image-receiving sheet including a substrate sheet and a dye-receiving layer formed on at least one surface of the substrate sheet. The dye-receiving layer of this heat transfer image-receiving sheet is composed of a resin containing a polar group and/or a salt thereof in an amount of 2 to 2000 equivalents per $10^6$ g of the resin. With the dye-receiving layer comprising the resin, a heat transfer image-receiving sheet, which can form thereon an image having a high density and good preservability, is provided.

9 Claims, No Drawings

HEAT TRANSFER IMAGE-RECEIVING SHEET AND HEAT TRANSFER PROCESS

DESCRIPTION

1. Technical Field

The present invention relates to a heat transfer image-receiving sheet and a heat transfer process. More particularly, the present invention relates to a heat transfer image-receiving sheet which can form thereon a recorded image having excellent color density, sharpness and fastness characteristics, and a heat transfer process.

2. Background Art

Various heat transfer methods have been known. Among these methods, there has been practically adopted a sublimation transfer process in which a heat transfer sheet formed by supporting a sublimable dye as a recording material on a substrate sheet such as a paper sheet is piled on a receiving material dyeable with the sublimable dye, for example, a polyester woven fabric, and heat energy is applied to an image to the assembly from the back surface of the heat transfer sheet to transfer the sublimable dye to the receiving material.

In this sublimation transfer process, in case of the sublimation transfer printing using a polyester woven fabric or the like as the receiving material, since the application of heat energy is conducted for a relatively long time, the heat transfer sheet is sufficiently heated and the receiving material per se is heated by the applied heat energy, and therefore, relatively good transfer of the dye can be accomplished.

However, with the recent development of recording techniques, there is often adopted a method in which a receiving material comprising a dye-receiving layer formed on a polyester sheet or paper is used and a fine letter or pattern or a photographic image is formed on the receiving material at a high speed by using a thermal head or the like. In this method, it is required that the time for the application of heat energy should be very short and shorter than the time expressed in seconds. Since the sublimable dye and the receiving material are not sufficiently heated if the application of heat energy is conducted only for such a short time, an image having a sufficient density cannot be obtained.

A sublimable dye having excellent subliming characteristics has been developed as the dye capable of coping with this high speed recording. In general, however, a dye having excellent subliming characteristics has a low molecular weight, and therefore, after the transfer, the dye tends to migrate into the receiving material with the lapse of time or to bleed out to the surface, with the result that the formed image is disturbed or becomes obscure and the problem of contamination of a surrounding article arises.

If a sublimable dye having a relatively high molecular weight is used for avoiding these disadvantages, in the above-mentioned high-speed recording method, since the sublimation speed is low, an image having a satisfactory density cannot be obtained.

DISCLOSURE OF THE INVENTION

It is therefore a primary object of the present invention to provide a heat transfer image-receiving sheet for use in the heat transfer process using a sublimable dye, which can give a sharp image having a sufficient density and excellent fastness characteristics even if the time of application of the heat energy is very short.

In accordance with the present invention, this object can be attained by a heat transfer image-receiving sheet comprising a substrate sheet and a dye-receiving layer formed on at least one surface of the substrate sheet, wherein said dye-receiving layer comprises a resin containing a polar group and/or a salt thereof in an amount of 2 to 2,000 equivalents per $10^6$ g of the resin, and a heat transfer process using the receiving sheet.

If a receiving layer of the heat transfer image-receiving sheet is formed of a polar resin having a specific polar group concentration, even when a dye having a relatively low molecular weight is used, the bleeding resistance of the received dye is improved and an image having excellent sharpness, density and preservability can be formed. Furthermore, even if a dye having a relatively high molecular weight is used, since the dye-receiving property is excellent, an image having excellent sharpness, density and preservability can similarly be obtained.

When a sublimable dye having a basic amine (an amino group, an imino group or the like) is used, the bleeding resistance is further improved since the dye is caught by the polarity in the receiving layer.

BEST MODE FOR CARRYING OUT THE INVENTION

The present invention will now be described in detail with reference to the detailed embodiments.

The heat transfer image-receiving sheet of the present invention comprises a substrate sheet and a dye-receiving layer formed on at least one surface of the substrate sheet.

As the substrate sheet used in the present invention, there can be mentioned artificial papers (such as polyolefin papers and polystyrene papers), cellulose fiber papers such as wood free paper, art paper, coated paper, cast-coated paper, wall paper, synthetic resin- or emulsion-impregnated paper, synthetic rubber latex-impregnated paper, synthetic resin-internally-added paper and paper board, films and sheets of polyolefins, polyvinyl chloride, polyethylene terephthalate, polystyrene, polymethacrylates and polycarbonates, and foamed products of these plastic sheets.

Laminates of optional combinations of the foregoing substrate sheets can be used. As typical instances, there can be mentioned a laminate of cellulose fiber paper and artificial paper, and a laminate of cellulose fiber paper and a plastic film or sheet or a foamed product thereof.

The dye-receiving layer formed on the substrate sheet is a layer for receiving a sublimable dye transferred from the heat transfer sheet and maintaining the formed image thereon.

The dye-receiving layer is composed mainly of a polar resin having a specific polar group concentration, but a mixture of such a polar resin and a resin having no polarity can also be used.

In the present invention, the term "polar resin" is meant to denote a resin in which a polar group as described below is incorporated in a specific amount. The polar group concentration is expressed by the number of polar groups, other than hydroxyl groups, that are to be incorporated into the resin at the synthesis or modification of the resin as the equivalent value per unit weight ($10^6$ g) of the resin.

In order to attain the intended effect of the present invention, the polar group concentration is adjusted to 2 to 2000 equivalents. In order to attain a better effect, the polar group concentration is preferably 20 to 1000 equivalents and especially preferably 120 to 1000 equivalents.

In order to obtain a better dye-receiving effect, it is preferable that the polar group concentration be at least 20 equivalents. If the polar group concentration is lower than 20 equivalents, the effect of increasing the printing sensitivity is low (that is, the affinity between the dye and the resin of the receiving layer is increased only slightly). If the polar group concentration exceeds 2000 equivalents, the thermal stability of the resin of the dye-receiving layer is reduced, and the dye-holding property is degraded and the bleeding resistance or contamination-inhibiting property becomes insufficient.

In the present invention, by the polar resin is meant a resin in which a polar group and/or a salt thereof (an alkali metal salt or alkaline metal salt) is introduced into terminals and/or side chains of the polymer skeleton, though the introducing method is described in detail hereinafter. However, if a hydroxyl group is incorporated as the polar group into the resin, the polarity and printing sensitivity are not increased but the sensitivity is rather reduced. Therefore, the introduction of the hydroxyl group is not preferable.

Modification products of resins described below can be used as the polar resin in the present invention.

(a) Resins having an ester bond, such as a polyester resin, a polyacrylic acid ester resin, a polycarbonate resin, a polyvinyl acetate resin, a styrene acrylate resin and a vinyltoluene acrylate resin.
(b) Resins having a urethane bond, such as a polyurethane resin.
(c) Resins having an amide bond, such as a polyamide resin (nylon).
(d) Resins having a urea bond, such as a urea resin.
(e) Other resins having a bond having a high polarity, such as a polycaprolactone resin, a polystyrene resin, a polyvinyl chloride resin and a polyacrylonitrile resin.

Of the foregoing synthetic resins, a polyester resin and a vinyl resin are especially preferably used.

The polar resin used in the present invention can be obtained by modifying a resin with a modifier at or after the synthesis. For the modification at the synthesis, in the case of polycondensation type resins such as a polyester resin, a polyurethane resin, a polyamide resin and a polycarbonate resin, there can be adopted a method in which at the synthesis of the resin, a dicarboxylic acid or diamine is used in an excessive amount, or an acid or amine having a valency of at least 3 is used. Furthermore, as the modifier used at the synthesis, there can be mentioned dicarboxylic acids and diamines having an additional polar group such as a carboxyl group, a sulfonic acid group, a sulfuric acid ester group, a phosphoric acid group, a phosphoric acid ester group, a primary, secondary, tertiary or quaternary amino group or a nitro group.

In case of a vinyl resin of the addition polymerization type, a polymer having a desired polar group concentration can be obtained by using a monomer having a polar group as a part of the monomer to be polymerized. As the modifying monomer used in this method, there can be mentioned vinyl monomers having an additional polar group such as a carboxyl group, a sulfonic acid group, a sulfuric acid ester group, a phosphoric acid group, a phosphoric acid ester group, a primary, secondary, tertiary or quaternary amino group or a nitro group.

In the case where the modification is carried out after the synthesis, the modification can be accomplished by modifying or grafting a resin having a double bond, an active hydrogen atom (a hydroxyl group, an amino group or an amide group), an epoxy group, an isocyanate group or the like with a compound having a polar group as described above.

The heat transfer image-receiving sheet of the present invention can be obtained by coating a solution of a polar resin as mentioned above or its mixture with another resin in an appropriate solvent or a dispersion of a polar resin as mentioned above or its mixture with other resin in an organic solvent or water on at least one surface of the above-mentioned substrate sheet and drying the coated substrate sheet to form a dye-receiving layer. In the case where a mixture of a polar resin and a resin not modified by the above-mentioned method is used, it is preferred that the amount of the polar resin be at least 5% by weight, especially at least 10% by weight, based on the sum of both of the resin.

In forming the dye-receiving layer, in order to improve the whiteness of the dye-receiving layer and further increase the sharpness of the transferred image, a pigment or filler such as titanium oxide, zinc oxide, kaolin, clay, calcium carbonate or finely divided silica can be added. Furthermore, in order to further increase the light resistance of the transferred image, an ultraviolet absorbant and/or a light stabilizer can be incorporated into the dye-receiving layer.

The thickness of the dye-receiving layer is not particularly critical, but the thickness is generally 3 to 50 μm. It is preferred that the dye-receiving layer be formed as a continuous covering layer. A discontinuous covering layer can be formed by using a resin emulsion or resin dispersion. However, in view of the operation adaptability, the productivity and the gloss of the coating, use of a resin emulsion is not preferred.

The heat transfer image-receiving sheet of the present invention can be sufficiently used even if the sheet has the above-mentioned structure. However, an inorganic powder can be incorporated for preventing heat fusion bonding to the heat transfer sheet. According to this embodiment, even if the heat transfer temperature is further elevated, heat fusion bonding between the heat transfer sheet and the heat transfer image-receiving sheet can be prevented and the heat transfer can be performed very effectively. In particular, finely divided silica is preferably used for this purpose.

A resin having a good release property can be added instead of or in combination with the above-mentioned inorganic powder such as silica. A cured silicone compound, for example, a cured product of an epoxy-modified silicone oil or an amino-modified silicone oil, is preferably used as the releasing resin. It is preferred that the releasing agent be incorporated in an amount of about 0.5 to about 30% by weight based on the dye-receiving layer.

The heat transfer sheet used when the heat transfer is carried out by using the heat transfer image-receiving sheet of the present invention is a sheet formed by forming a dye layer containing a sublimable dye on a paper or polyester film, and any of known heat transfer sheets can be directly used in the present invention.

As the result of research made by the invention, it was found that a dye containing at least one of primary, secondary and tertiary amino groups is preferably used as the sublimable dye, and it also was found that if an indoaniline, cyanoacetyl or anthraquinone dye is used, an especially good image can be formed.

Any of known means for applying heat energy at the heat transfer can be used in the present invention. For example, the intended object can be sufficiently attained by applying about 5 to about 100 mJ/mm$^2$ of heat energy while controlling the recording time by using a recording device such as a thermal printer (for example, Video Printer VY-100 supplied by Hitachi).

As is apparent from the foregoing description, according to the present invention, by using a polar resin having a specific polar group concentration for forming a dye-receiving layer of a heat transfer image-receiving sheet, a sharp image having a high density is obtained and since this image is excellent in the bleeding resistance and the contamination-preventing property, even if the image is stored for a long time, the sharpness of the image is not degraded and even if the image falls in contact with another article, the image does not contaminate the article. Thus, various problems involved in the conventional techniques can be solved according to the present invention.

The present invention will now be described in detail with reference to the following examples and comparative examples. Incidentally, all of parts and % are by weight unless otherwise indicated.

EXAMPLES 1 THROUGH 8 AND COMPARATIVE EXAMPLES 1 THROUGH 7

An artificial paper (supplied by Oji Yuka K. K., Japan and having a thickness of 110 μm) was used as the substrate sheet, and a coating liquid having a composition described below was coated on one surface of the artificial paper by a wire bar so that the amount coated was 5.0 g/m$^2$ in the dry state. The coated paper was dried to obtain a heat transfer image-receiving sheet of the present invention or a comparative receiving sheet.

| | |
|---|---|
| Polymer described below | 20.0 parts |
| Amino-modified silicone (X-22-3050C supplied by Shinetsu Kagaku Kogyo K.K., Japan) | 0.8 part |
| Epoxy-modified silicone (X-22-3000E supplied by Shinetsu Kagaku Kogyo K.K., Japan) | 0.8 part |
| Methylethylketone/toluene (1/1 weight ratio) | 80.0 parts |

A dye-supporting layer-forming ink having a composition described below was prepared and was then coated on a polyethylene terephthalate film having a thickness of 6 μm, the back surface of which had been subjected to a heat-resistant treatment, by a wire bar so that the amount coated was 1.0 g/m$^2$ in the dry state. The coated film was dried to obtain a heat transfer sheet.

| | |
|---|---|
| C.I. Disperse Blue 24 | 3.5 parts |
| Polyvinyl butyral resin | 4.5 parts |
| Methylethylketone/toluene (1/1 weight ratio) | 92.0 parts |

The heat transfer sheet was piled on the heat transfer image-receiving layer of the present invention or the comparative receiving sheet so that the dye layer confronted the dye-receiving surface, and recording by a thermal head was carried out under conditions of a pulse width of 2 to 16 msecs, a printing frequency of 1 msec and a dot density of 6 dots/line while applying a printing voltage of 12.0 V from the rear surface of the heat transfer sheet. The obtained results are shown in Table 1. Incidentally, the performances described in Table 1 were evaluated according to the following methods.

(1) Printing sensitivity

The reflection density of the image formed on the heat transfer image-receiving sheet under the above printing conditions was measured (Macbeth Densitometer RD-914), and the maximum density was selected. In Table 1, the maximum density in Comparative Example 1 is regarded as 1.0, and in Examples 1 through 8 and Comparative Examples 2 through 7 in Table 1, values calculated on the basis of the difference of the density from that of Comparative Example 1 are shown.

(2) Diffusion of dots (blurring of dots)

The heat transfer image-receiving sheet on which the image was formed under the above printing conditions was allowed to stand still in a room maintained at a temperature of 60° C. and a relative humidity lower than 50% for 200 hours. The degree of diffusion of dots was checked with the naked dye and evaluated according to the following three-rank method to obtain results shown in Table 1.

1: no diffusion of dots
2: small diffusion of dots
3: large diffusion of dots (3) Contaminating property of print The image-bearing surface of the heat transfer image-receiving sheet, on which the image was formed under the above conditions, was applied to an artificial paper having a thickness of 110 μm, and a load of 20 g/cm$^2$ was applied to the assembly and the assembly was allowed to stand still at 60° C. for 3 days. The reflection density of the dye transferred to the artificial paper was measured (Macbeth Densitometer RD-915) to obtain the results shown in Table 1.

The kinds of resins used in the respective examples and the polar group concentrations thereof are described below.

EXAMPLE 1

A resin (polar group concentration = 135 equivalents per 10$^6$ g of resin, Tg = 40° C.) formed by grafting vinylsulfonic acid to a polyester resin having partially an unsaturated double bond.

EXAMPLE 2

A resin (polar group concentration = 400 equivalents per 10$^6$ g of resin, Tg = 50° C.) formed by grafting diethylaminoethyl methacrylate to a polyester resin having partially an unsaturated double bond.

EXAMPLE 3

A resin (polar group concentration = 145 equivalents per 10$^6$ g of resin, acid value = 12 mg/g of resin, Tg = 72° C.) formed by modifying a polyester resin with trimellitic anhydride.

EXAMPLE 4

A resin (ester group bond concentration = 500 equivalents per 10$^6$ g of resin, Tg = 55° C.) formed by esterifying a vinyl chloride/vinyl alcohol/ethyl acrylate copolymer with sulfuric acid.

EXAMPLE 5

A resin (phosphoric acid ester group concentration = 600 equivalents per $10^6$ g of resin, Tg = 40° C.) formed by esterifying a vinyl chloride/vinyl alcohol/ethyl acrylate copolymer with phosphoric acid.

EXAMPLE 6

A vinyl chloride/nitrostyrene/butyl acrylate copolymer (polar group concentration = 150 equivalents per $10^6$ g of resin, Tg = 45° C.).

EXAMPLE 7

A vinyl chloride/styrene-sulfonic acid/vinyl acetate copolymer (polar group concentration = 50 equivalents per $10^6$ g of resin).

EXAMPLE 8

A resin (polar group concentration = 4.5 equivalents per $10^6$ g of resin) formed by grafting sodium vinylsulfonate to an unsaturated polyester resin.

COMPARATIVE EXAMPLE 1

The polyester resin partially having an unsaturated bond, used in Example 1 (polar group concentration = 1.2 equivalents per $10^6$ g of resin).

COMPARATIVE EXAMPLE 2

The polyester resin partially having an unsaturated double bond, used in Example 2 (polar group concentration = 0.9 equivalent per $10^6$ g of resin).

COMPARATIVE EXAMPLE 3

The polyester resin used in Example 3 (polar group concentration = 1.5 equivalent per $10^6$ g of resin).

COMPARATIVE EXAMPLE 4

The vinyl chloride/vinyl alcohol/ethyl acrylate copolymer used in Examples 4 and 5 (polar group concentration = 0.0 equivalent per $10^6$ g of resin).

COMPARATIVE EXAMPLE 5

A vinyl chloride/butyl acrylate copolymer (polar group concentration = 0.0 equivalent per $10^6$ g of resin).

COMPARATIVE EXAMPLE 6

A vinyl chloride/vinyl acetate copolymer (polar group concentration = 0.0 equivalent per $10^6$ g of resin).

COMPARATIVE EXAMPLE 7

The polyester resin having an unsaturated double bond, used in Example 8 (polar group concentration = 1.5 equivalents per $10^6$ g of resin).

TABLE 1

| Image-Receiving Sheet | Printing Sensitivity | Diffusion of Dots | Contaminating Property of Print |
|---|---|---|---|
| Example 1 | 1.2 | 1 | 0.10 |
| Example 2 | 1.0 | 1 | 0.08 |
| Example 3 | 1.0 | 1 | 0.11 |
| Example 4 | 1.2 | 1 | 0.11 |
| Example 5 | 1.1 | 1 | 0.10 |
| Example 6 | 1.0 | 1 | 0.09 |
| Example 7 | 0.92 | 1 | 0.09 |
| Example 8 | 0.91 | 1 | 0.09 |
| Comparative Example 1 | 1.0 | 1 | 0.12 |
| Comparative Example 2 | 0.8 | 1 | 0.09 |
| Comparative Example 3 | 0.7 | 2 | 0.15 |
| Comparative Example 4 | 1.0 | 2 | 0.09 |
| Comparative Example 5 | 0.9 | 1 | 0.07 |
| Comparative Example 6 | 0.86 | 1 | 0.10 |
| Comparative Example 7 | 0.79 | 2 | 0.12 |

When the foregoing resins were used in the form of salts, similar results were obtained.

As is apparent from the foregoing description, according to the present invention, by using a resin having a specific polar group concentration as the resin forming a receiving layer of a heat transfer image-receiving sheet, since a dye is fixed at a high concentration by the polar group, an effect of obtaining a good colored image having a good bleeding resistance and a good contamination-preventing property can be attained.

INDUSTRIAL APPLICABILITY

The heat transfer image-receiving sheet of the present invention can be widely used as an image-receiving sheet in combination with a heat transfer sheet having a dye layer in the heat transfer image-forming system.

What is claimed is:

1. A heat transfer image-receiving sheet comprising:

a substrate sheet; and a dye-receiving layer formed on at least one surface of the substrate sheet;

wherein the dye-receiving layer comprises a modified resin comprising a modified polyester resin or a modified vinyl resin, the modified resin being obtained by introducing a polar group and/or a salt of the polar group into terminals and/or side chains of the modified resin-constituting polymer skeleton, wherein the polar group comprises a group selected from the group consisting of carboxyl group, sulfonic acid group, sulfuric acid ester group, phosphoric acid group, phosphoric acid ester group, amino group, cyano group and nitro group.

2. The heat transfer image-receiving sheet of claim 1, wherein the modified resin contains a polar group and/or a salt of the polar group in an amount of 20 to 2000 equivalents per $10^6$ g of the modified resin.

3. The heat transfer image-receiving sheet of claim 1, wherein the modified resin contains a polar group and/or a salt of the polar group in an amount of 20 to 1000 equivalents per $10^6$ g of the modified resin.

4. The heat transfer image-receiving sheet of claim 1, wherein the modified resin contains a polar group and/or a salt of the polar group in an amount of 120 to 1000 equivalents per $10^6$ g of the modified resin.

5. A heat transfer process comprising the steps of:

providing (a) a heat transfer sheet having a sublimable dye-containing layer and (b) an image-receiving sheet, the image-receiving sheet comprising a substrate sheet and a dye-receiving layer formed on at least one surface of the substrate sheet, wherein the dye-receiving layer comprises a modified resin comprising a modified polyester resin or a modified vinyl resin, the modified resin being obtained by introducing a polar group and/or a salt of the polar group into terminals and/or side chains of the modified resin-constituting polymer skeleton, wherein the polar group comprises a group selected from the group consisting of carboxyl group, sulfonic acid group, sulfuric acid ester group, phosphoric acid group, phosphoric acid ester group, amino group, cyano group and nitro group;

bringing the heat transfer sheet into contact with the receiving layer of the image-receiving sheet; and carrying out heat transfer according in accordance with information for printing to thereby form an image on the dye-receiving layer.

6. The heat transfer process of claim 5, wherein the modified resin contains a polar group and/or a salt of the polar group in an amount of 20 to 2000 equivalents per $10^6$ g of the modified resin.

7. The heat transfer process of claim 5, wherein the dye contained in the sublimable dye-containing layer of the heat transfer sheet is a sublimable dye having a primary, secondary or tertiary amine in the dye molecule.

8. The heat transfer process of claim 5, wherein the modified resin contains a polar group and/or a salt of the polar group in an amount of 20 to 1000 equivalents per $10^6$ g of the modified resin.

9. The heat transfer process of claim 5, wherein the modified resin contains a polar group and/or a salt of the polar group in an amount of 120 to 1000 equivalents per $10^6$ g of the modified resin.

* * * * *